US006516763B1

(12) United States Patent
Strauss

(10) Patent No.: US 6,516,763 B1
(45) Date of Patent: Feb. 11, 2003

(54) METHOD OF CONTROLLING A DEVICE THAT VARIES THE VALVE CONTROL TIMES AN INTERNAL COMBUSTION ENGINE, ESPECIALLY OF A CAMSHAFT ADJUSTING DEVICE WITH HYDRAULICALLY RELEASEABLE START LOCK

(75) Inventor: Andreas Strauss, Forchheim (DE)

(73) Assignee: INA Walzlager Schaeffler oHG (DE)

( * ) Notice: Subject to any disclaimer, the term of this patent is extended or adjusted under 35 U.S.C. 154(b) by 0 days.

(21) Appl. No.: 10/019,549

(22) PCT Filed: May 10, 2000

(86) PCT No.: PCT/EP00/04161

§ 371 (c)(1),
(2), (4) Date: Apr. 16, 2000

(87) PCT Pub. No.: WO01/00968

PCT Pub. Date: Jan. 4, 2001

(30) Foreign Application Priority Data

Jun. 26, 1999 (DE) ..... 199 29 393

(51) Int. Cl.[7] ..... F01L 1/34

(52) U.S. Cl. ..... 123/90.17; 123/90.12; 123/90.15; 123/90.16; 123/90.27; 123/90.31; 251/12; 251/213; 464/1; 464/2; 464/160

(58) Field of Search ..... 123/90.27, 90.31, 123/90.12, 90.15, 90.16, 90.17; 251/12, 213; 464/1, 2, 160

(56) References Cited

U.S. PATENT DOCUMENTS 5,450,825 A * 9/1995 Geyer et al. ..... 123/90.17
5,549,080 A * 8/1996 Uchikawa et al. ..... 123/90.16
5,598,814 A * 2/1997 Schroeder et al. ..... 123/90.11
5,836,277 A 11/1998 Kira et al. ..... 123/90.17

FOREIGN PATENT DOCUMENTS

| | | |
|---|---|---|
| DE | 19726300 | 1/1998 |
| EP | 0808997 | 11/1997 |
| EP | 0857859 | 8/1998 |
| EP | 0896129 | 2/1999 |

* cited by examiner

*Primary Examiner*—Thomas Denion
*Assistant Examiner*—Ching Chang
(74) *Attorney, Agent, or Firm*—Bierman, Muserlian and Lucas

(57) ABSTRACT

A method of actuating a device for varying the valve timing of an internal combustion engine without jamming of the locking element during starting of the internal combustion engine, the solenoid of the hydraulic valve is at first energized through a number of high frequency cycles of high and low energization that are broken off after a defined period of time or after a defined number of cycles, followed by a renewed energization of the solenoid with a high energization with a simultaneous check by the microprocessor to determine whether the element fixed to the camshaft has been angularly displaced relative to the element fixed to the crankshaft out of its basic position whereby if the microprocessor determines that the element fixed to the crankshaft is still in the basic position, the first two phases of energization are repeated and the microprocessor has determined an angular displacement of the element fixed to the camshaft, the solenoid is energized with a current defined by the microprocessor which is of a higher intensity than that required for the central position of the valve piston of the hydraulic valve.

7 Claims, 3 Drawing Sheets

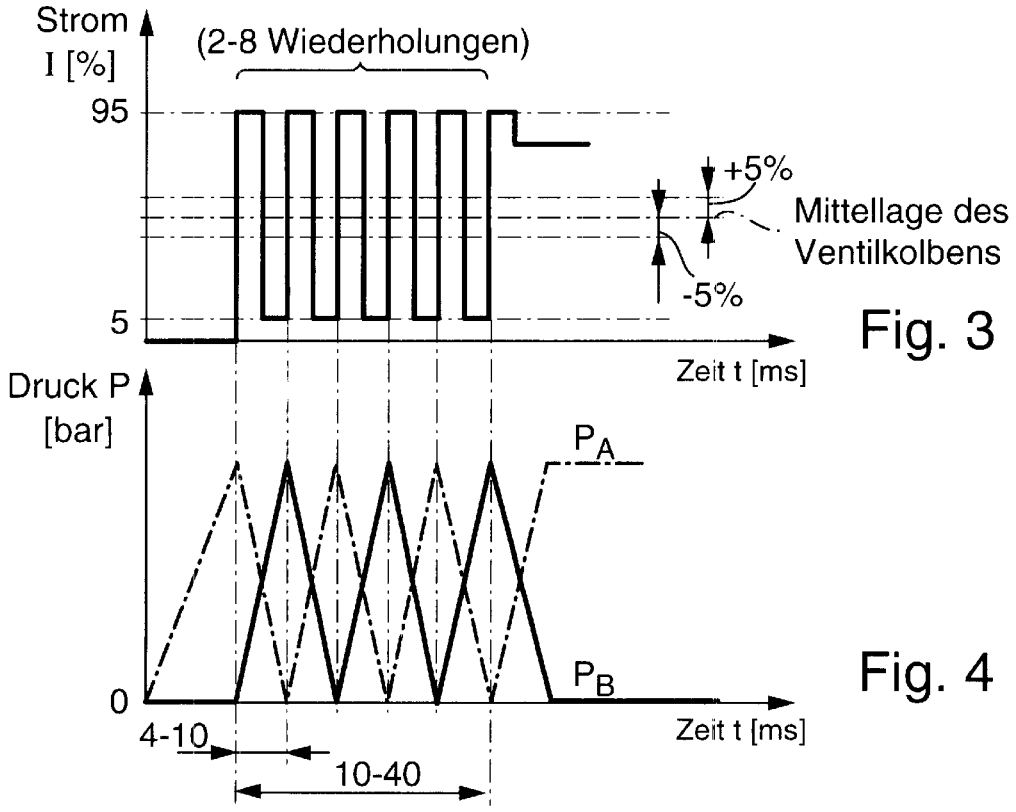
Fig. 3
Fig. 4
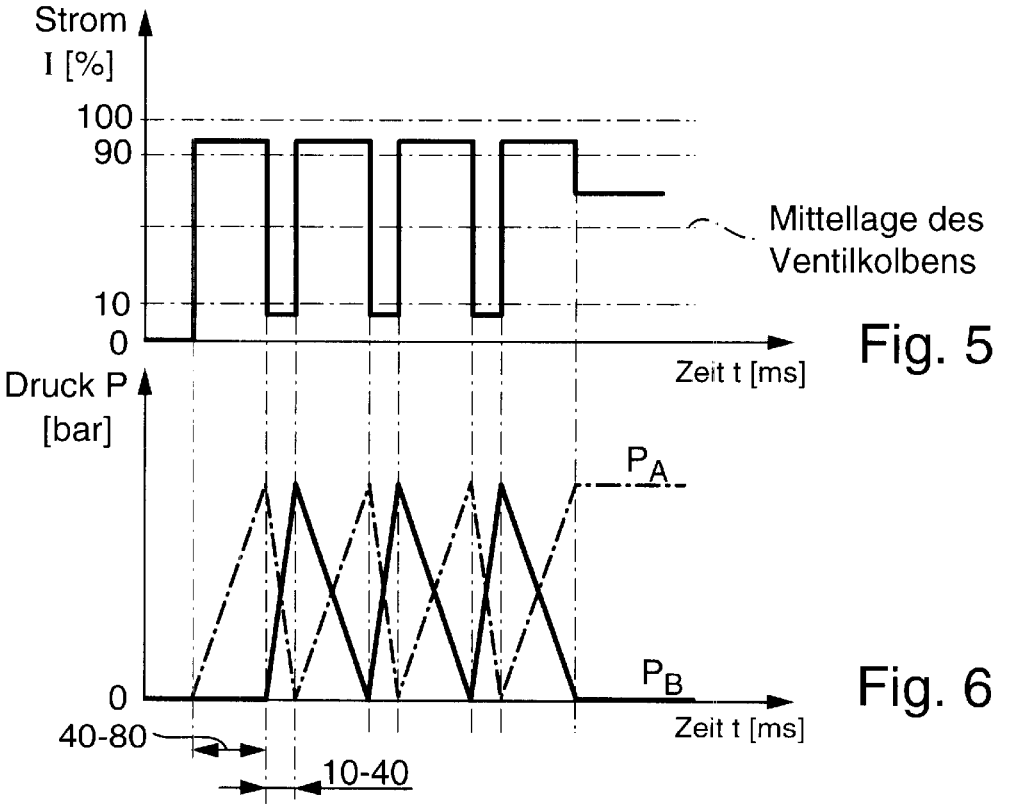
Fig. 5
Fig. 6

METHOD OF CONTROLLING A DEVICE THAT VARIES THE VALVE CONTROL TIMES AN INTERNAL COMBUSTION ENGINE, ESPECIALLY OF A CAMSHAFT ADJUSTING DEVICE WITH HYDRAULICALLY RELEASEABLE START LOCK

FIELD OF THE INVENTION

The invention concerns a method of actuating a device for varying the valve timing of an internal combustion engine, which method can be advantageously implemented particularly in all types of camshaft adjusting devices having a hydraulically releasable start locking.

BACKGROUND OF THE INVENTION

Such a method relates particularly to camshaft adjusting devices of the generic type disclosed in DE-OS 197 26 300. These devices, generally designated in the technical field as axial piston and rotary piston adjusting devices, are arranged, irrespective of their structure, on the drive-side end of a camshaft mounted in the cylinder head of the internal combustion engine while being generally configured as hydraulic adjusting drives that comprise an element fixed in driving relationship to the crankshaft of the internal combustion engine and an element rotationally fixed to the camshaft. The element fixed to the crankshaft is in power-transmitting relationship with the element fixed to the camshaft through at least one hydraulic working chamber configured within the device, each hydraulic working chamber being divided by an adjusting element within the device into a so-called. A pressure chamber and a B pressure chamber. A pivoting or fixing of the element fixed to the camshaft relative to the element fixed to the crankshaft is effected by a selective or a simultaneous pressurizing of the A and/or B pressure chamber of each hydraulic working chamber, the pressurizing of the pressure chambers being controlled by an electromagnetically actuated valve piston of a hydraulic valve whose solenoid is actuated by a microprocessor as a function of different operation parameters of the internal combustion engine. Normally, this valve piston of the hydraulic valve permits, in a non-energized or low energized state of the solenoid, a pressurization of the B pressure chamber of each hydraulic working chamber, in a high or maximum energized state of the solenoid, a pressurization of the A pressure chamber of each hydraulic working chamber, and in a central position, a holding of the pressure medium pressure in both pressure chambers of each hydraulic working chamber of the device. When the internal combustion engine has been switched off and the volume of the A pressure chamber of each hydraulic working chamber is minimized, the element fixed to the camshaft can be mechanically coupled to the element fixed to the crankshaft in a preferred basic position for starting the internal combustion engine, coupling be achieved by an additional locking element arranged on the element fixed to the camshaft or on the element fixed to the crankshaft, which locking element can be displaced by a spring element into a coupling position within a complementary reception in the element fixed to the crankshaft or in the element fixed to the camshaft. This complementary reception of the locking element is hydraulically connected to the pressure medium supply to the volume-minimized A pressure chamber of at least one hydraulic working chamber of the device, so that, upon pressurization of the volume-minimized A pressure chamber of each hydraulic working chamber during starting of the internal combustion engine, the reception of the locking element is likewise pressurized and the locking element is displaced hydraulically, against the force of its spring element, into an uncoupling position.

This shock-like pressurization of the volume-minimized A pressure chamber generally effected by a short pulse on the solenoid at maximum energization has proved to be a drawback in practice because the sudden rise of pressure in all the volume-minimized A pressure chambers causes a bracing moment to act on the locking element which leads to a jamming of the locking element in its coupling position particularly when the mean moment of drag of the camshaft acts in the same direction as the bracing moment and/or when the time for building up the bracing moment is shorter than the time for displacing the locking element into its uncoupling position. As a consequence, a relative rotation between the element fixed to the camshaft and the element fixed to the crankshaft into a defined angle given by the microprocessor is no longer possible, so that, for example, in the case of inlet-side camshaft adjusting devices there are performance deficits of the internal combustion engine, and in the case of outlet-side camshaft adjusting devices, the internal combustion engine has higher emission values.

OBJECT OF THE INVENTION

The object of the invention is therefore to provide a method of actuating a device for varying the valve timing of an internal combustion engine, particularly a camshaft adjusting device having a hydraulically releasable start locking, which method enables a reliable prevention of a jamming of the locking element in its coupling position even when a bracing moment resulting from a pressurization and a mean moment of drag of the camshaft impede movement of the locking element in the same direction.

SUMMARY OF THE INVENTION

The invention achieves this object in a camshaft adjusting device having a hydraulically releasable start locking, said device generally comprising following features:

- the device (1) is arranged on the drive-side end of a camshaft (3) mounted in the cylinder head of the internal combustion engine and generally configured as a hydraulic adjusting drive,
- said device (1) comprising an element (4) fixed in driving relationship to a crankshaft of the internal combustion engine and an element (5) rotationally fixed to the camshaft (3),
- the element (4) fixed to the crankshaft is in powder-transmitting relationship with the element (5) fixed to the camshaft through at least one hydraulic working chamber (6) formed within the device (1),
- each hydraulic working chamber (6) of the device (1) is divided by an adjusting element (7) within the device (1) into a pressure chamber (8) and a pressure chamber (9),
- a pivoting or fixing of the element (5) fixed to the camshaft relative to the element (4) fixed to the crankshaft is effected by a selective or a simultaneous pressurizing of the pressure chamber (8, 9) of each hydraulic working chamber (6),
- the pressurizing of pressure chamber (8, 9) of each hydraulic working chamber (6) is regulated by an electromagnetically actuated valve piston of a hydraulic valve (10) whose solenoid (11) is actuated by a micro processor (12) as a function of different operation parameters of the internal combustion engine, the valve piston of the hydraulic valve (10) permits, in a non-energized or low energized state of the solenoid (11), a pressurization of the pressure chamber (9), in a high or maximum energized state of the solenoid (11), a pressurization of the pressure chamber (8), and in a central position, a holding of the pressure medium pressure (P) in both pressure chambers (8, 9) of each hydraulic working chamber (6) of the device (1), when the internal combustion engine has been switched off and the volume of the pressure chamber (8) of each hydraulic working chamber (6) has been minimized, the element (5) fixed to the camshaft can be mechanically coupled to the element (4) fixed to the crankshaft in a preferred basic position for starting the internal combustion engine, the mechanical coupling is achieved by a locking element (13) arranged on the element (5) fixed to the camshaft or on the element (4) fixed to the crankshaft, which locking element (13) can be displaced by a spring element (14) into a coupling position within a complementary reception (15) in the element (4) fixed to the crankshaft or in the element (5) fixed to the camshaft, the complementary reception (15) of the locking element (13) is hydraulically connected to the pressure medium supply (16) to volume-minimized pressure chamber (8) of at least one hydraulic working chamber (6) of the device (1), upon pressurization of the volume-minimized pressure chamber (8) of each hydraulic working chamber (6) during starting of the internal combustion engine, the reception (15) of the locking element (13) is likewise pressurized and the locking element (13) is displaced hydraulically, against the force of its spring element (14), into an uncoupling position, by the fact that the solenoid of the hydraulic valve (10) operated on starting of the internal combustion engine following a regulation strategy comprising the steps (a) energization for a defined period of time (t), through a number of high frequency cycles of high and low energization (1), or through a defined number of such cycles, so that the valve piston of the hydraulic valve (10) oscillates in a range about its central position and enables a rapid alternating pressurization of the pressure chambers (8, 9) of each hydraulic working chamber (6) of the device (1) with a pressure (P) with which the element (5) fixed to the camshaft is held in its basic position, (b) at the end of the defined period of time (t) or the last cycle, the routine is broken off and followed by a renewed energization or a holding of the high energization (1) for a further defined period of time (t) in which the microprocessor (12) simultaneously checks whether the element (5) fixed to the camshaft has been angularly displaced relative to the element (4) fixed to the crankshaft out of its basic-position and the locking element (13) has therefore taken its uncoupling position, (c) if the microprocessor (12) determines that the element (5) fixed to the camshaft is still in its basic position, steps (a) and (b) re repeated till the microprocessor (12) registers that the element (5) fixed to the camshaft has been angularly displaced relative to the element (4) fixed to the crankshaft out of its basic position and that the locking element (13) has therefore taken its uncoupling position, (d) when the microprocessor (12) determines an angular displacement of the element (5) fixed to the camshaft out of its basic position, energization with a current (1) defined by the Microprocessor (12) which is of a higher intensity than that required for the central position of the valve piston of the hydraulic valve (10) and corresponds to an adjusted angular position of the element (5) fixed to the camshaft relative to the element (4) fixed to the crankshaft.

Alternatively, the invention also achieves this object in the device by the fact that the solenoid of the hydraulic valve is operated on starting of the internal combustion engine following a regulation strategy comprising the steps:

a) energization with a high current (1) in a defined period of time (t), so that, at first, only the volume-minimized pressure chamber (8) of each hydraulic pressure chamber (6) of the device (1) and, thus also, the reception (15) of the locking element (13) is pressurized with a high pressure medium pressure ($P_A$), b) at the end of the defined period of time (t), the Microprocessor (12) checks whether the element (5) fixed to the camshaft has been angularly displaced relative to the element (4) fixed to the crankshaft out of its basic position and that the locking element (13) has therefore taken its uncoupling position, c) if the microprocessor (12) determines that the element (5) fixed to the camshaft is still in its basic position, the solenoid (11) is energized with a low current (1) for a further period of time (t) for a brief pressurization of the pressure chamber (9) of each hydraulic working chamber (6) with a pressure medium pressure ($P_B$) followed by a repetition of steps a) and b) till the microprocessor (12) registers that the element (5) fixed to the camshaft has been angularly displaced relative to the element (4) fixed to the crankshaft out of its basic position and that the locking element (13) has therefore taken its uncoupling position, d) after determination of an angular displacement of the element (5) fixed to the camshaft out of its basic position, energization with a current (1) defined by the microprocessor (12) which is of a higher intensity than that required for the central position of the valve piston of the hydraulic valve (10) and corresponds to an adjusted angular position of the element (5) fixed to the camshaft relative to the element (4) fixed to the crankshaft.

According to the first embodiment of the method of the invention, a so-called high frequency pulsed start of the device is effected in that the solenoid of the hydraulic valve is at first energized for a defined period of time through a number of high frequency cycles of high and low energization, or through a defined number of such cycles, so that the valve piston of the hydraulic valve oscillates in a range about its central position and thus enables a rapid alternating pressurization of the A and the B pressure chambers of each hydraulic working chamber of the device with a pressure medium pressure with which the element fixed to the camshaft is held in its basic position. At the end of the defined period of time or the last cycle, the said routine is broken off and this is followed by a renewed energization or a holding of the high energization for a further defined period of time in which the microprocessor simultaneously checks whether the element fixed to the camshaft has been angularly displaced relative to the element fixed to the crankshaft out of its basic position and the locking element has therefore taken its uncoupling position. If the microprocessor determines that the element fixed to the camshaft is still in its basic position, the cycles of high and low energization are repeated for the same defined period of time, or number of cycles, followed by a renewed energization or holding of the high energization till the microprocessor registers that the element fixed to the camshaft has been angularly displaced relative to the element fixed to the crankshaft out of its basic position and that the locking element has therefore taken its uncoupling position. When the microprocessor determines an angular displacement of the element fixed to the camshaft out of its basic position, the solenoid is energized with a current defined by the microprocessor which is of a higher intensity than that required for the central position of the valve piston of the hydraulic valve and corresponds to an adjusted angular position of the element fixed to the camshaft relative to the element fixed to the crankshaft.

According to an advantageous feature of this first embodiment of the method of the invention, it is further proposed to control the high and the low energization of the solenoid of the hydraulic valve preferably by a pulse width modulated voltage control of the microprocessor, so that the energization of the solenoid within one high frequency cycle is effected, once, with an electric current having an intensity between 5% above that required for the central position of the valve piston of the hydraulic valve and 95% of the maximum intensity, and, once, with an electric current having an intensity of between 5% of the maximum intensity and an intensity that is 5% lower than that required for the central position of the valve piston of the hydraulic valve. However, in place of a pulse width modulated voltage control with this setting, it is also possible to realize this with a current regulation of a known type. Within the limits of the above-defined control ranges, the share of high and low energization of the solenoid can be freely chosen in both cases to be symmetric or asymmetric and the form of the transition from high to low energization, and vice versa, to be sudden or gradual, or the like. The respective lower limits of the pulsation ranges of the valve piston of 5% above and 5% below the energization required for the central position have proved to be of advantage because they reliably prevent a sinking of the volume flow of the hydraulic pressure medium to the A and the B pressure chamber of each hydraulic working chamber below a value at which the basic position of the element fixed to the camshaft can no longer be maintained.

As a further feature of the first embodiment of the method of the invention, it is finally proposed that, if the criterion for breaking off the routine consisting of the high frequency cycles is defined in terms of time, the duration of a cycle is preferably between 4 ms and 10 ms and the period of time for all the cycles required to displace the locking element into its uncoupling position till the breaking off of the routine is limited to a range of 10 ms to 40 ms. If, in contrast, the criterion for breaking off is defined in numbers, advantageously, the number of high frequency cycles required to displace the locking element into its uncoupling position till the breaking off of the routine is limited to 2 to 8 repetitions. It has been shown in practice, that in most cases, already one routine limited in time or in number to the ranges defined above is sufficient for reliably displacing the locking element into its uncoupling position.

According to the second embodiment of the method of the invention, in contrast, a so-called low frequency pulsed start of the device is effected in that the solenoid of the hydraulic valve is at first energized with a high current in a defined period of time, so that only the volume-minimized A pressure chamber of each hydraulic pressure chamber of the device and, thus also, the reception of the locking element is pressurized with a high pressure medium pressure. At the end of this defined period of time, the microprocessor checks whether the element fixed to the camshaft has been angularly displaced relative to the element fixed to the crankshaft out of its basic position and the locking element has therefore taken its uncoupling position. If the microprocessor determines that the element fixed to the camshaft is still in its basic position, the solenoid is energized with a low current for a further period of time for a brief pressurization of the B pressure chamber of each hydraulic working chamber. This is followed by a renewed energization of the solenoid with a high current for a defined period of time till the microprocessor registers that the element fixed to the camshaft has been angularly displaced relative to the element fixed to the crankshaft out of its basic position and that the locking element has therefore taken its uncoupling position. After determination of an angular displacement of the element fixed to the camshaft out of its basic position, the solenoid is finally energized, in this embodiment, too, with a current defined by the microprocessor which is of a higher intensity than that required for the central position of the valve piston of the hydraulic valve and corresponds to an adjusted angular position of the element fixed to the camshaft relative to the element fixed to the crankshaft.

As an advantageous feature of this second embodiment of the method of the invention, too, it is proposed to control the energization of the solenoid of the hydraulic valve preferably by a pulse width modulated voltage control of the microprocessor, so that the energization of the solenoid with a high current is effected preferably between 90% and 100% of the maximum electric current, and the energization of the solenoid with a low current is effected preferably between 0% and 10% of the maximum electric current. Similar to the first embodiment of the method of the invention, this can also be alternatively achieved using a current regulation of a known type. Within the above-defined control ranges, the share of high and low energization of the solenoid can be freely chosen in both cases to be symmetric or asymmetric. The duration of high energization is preferably set between 40 ms an 80 ms while the duration of low energization is limited to a range of between 10 ms and 40 ms. The purpose of this brief low energization of the solenoid and the accompanying pressurization of the B pressure chamber of each hydraulic working chamber is to bring the element fixed to the camshaft that, due to the previous pressurization of the A pressure chamber of each hydraulic working chamber, has been rotated through an angle (up to 1° crankshaft angle) corresponding to the operational play of movement of the locking element and that may be jamming the locking element, back into a position in which the locking element can move freely for the next releasing attempt.

Both embodiments of the method of the invention for actuating a device for varying the valve timing of an internal combustion engine, particularly a camshaft adjusting device having a hydraulically releasable start locking thus permit, in contrast to prior art actuating methods for devices of a similar type, a reliable prevention of a jamming of the locking element in its coupling position during the starting of the internal combustion engine even when a bracing moment resulting from the pressurization of the volume-minimized A pressure chamber of each hydraulic working chamber of the device and a mean moment of drag of the camshaft impede movement of the locking element in the same direction. The high and low frequency energization of the solenoid of the hydraulic valve with a high and a low current and the accompanying alternating pressurization of the A and the B pressure chamber of each hydraulic working chamber of the device causes a "jolting" movement of the locking element which guarantees a reliable movement of the locking element into its uncoupling position and, thus also, a reliable releasing of the start locking of the device. In this way, already immediately after the starting of the internal combustion engine, relative rotations between the element fixed to the camshaft and the element fixed to the crankshaft into defined angular positions given by the microprocessor are possible, and negative consequences such as reduced performance or increased emission of the internal combustion engine are excluded.

BRIEF DESCRIPTION OF THE DRAWINGS

The method according to the invention will now be described more closely with reference to examples of embodiment and the appended drawings.

FIG. 3 is a current-time diagram showing the flow of current in the solenoid of the hydraulic valve, according to a first embodiment of the method of the invention;

FIG. 4 is a pressure-time diagram showing the flow of pressure in the A and the B pressure chambers of each hydraulic working chamber of the device, according to the first embodiment of the method of the invention;

FIG. 5 is a current-time diagram showing the flow of current in the solenoid of the hydraulic valve, according to a second embodiment of the invention;

FIG. 6 is a pressure-time diagram showing the flow of pressure in the A and the B pressure chambers of each hydraulic working chamber of the device, according to the first embodiment of the method of the invention.

DETAILED DESCRIPTION OF THE INVENTION

Figure 1:
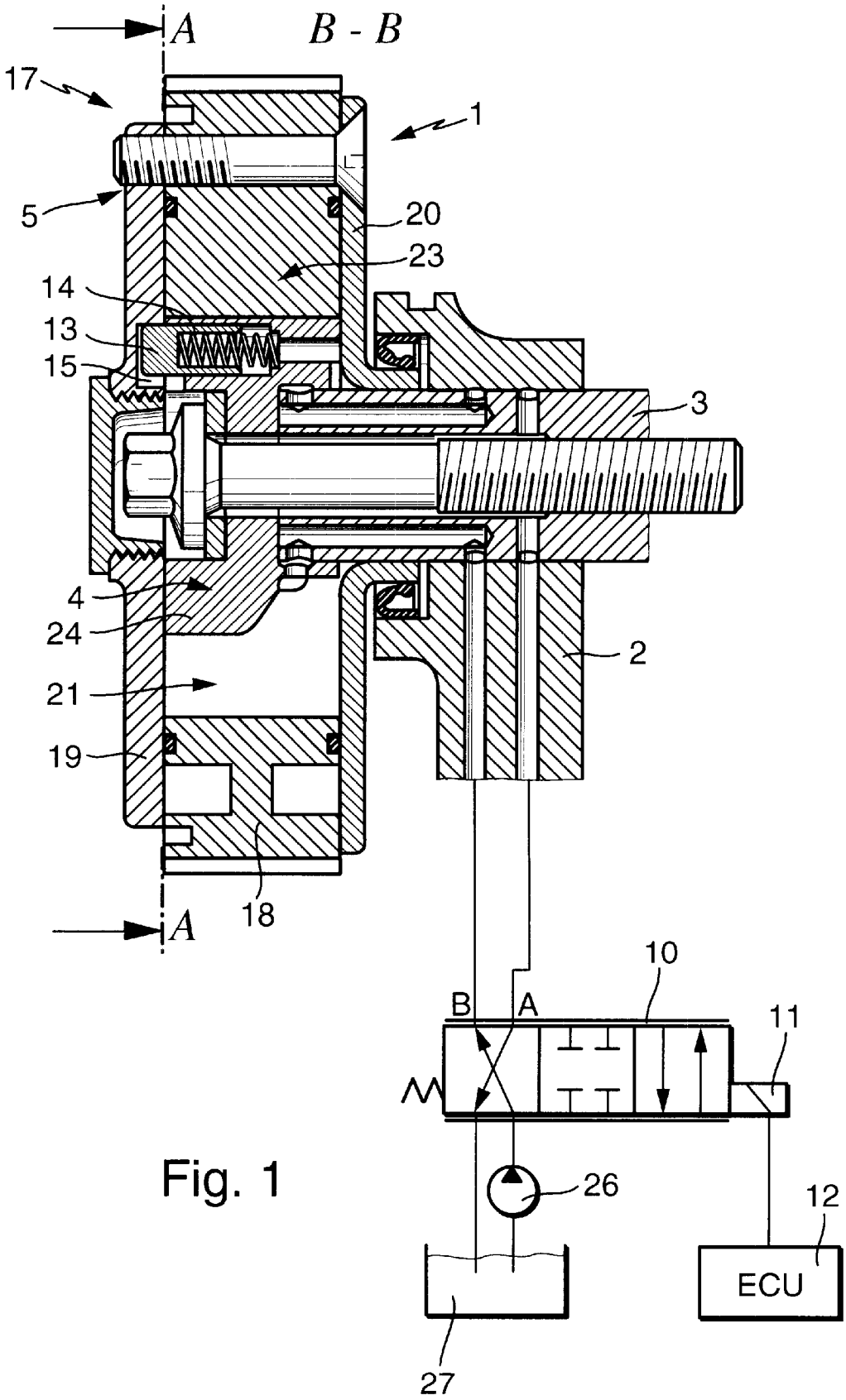
FIG. 1 shows a cross-section taken along line B—B of FIG. 2 through a camshaft adjusting device mounted on a camshaft, with a schematic representation of pressure medium control.
Figure 2:
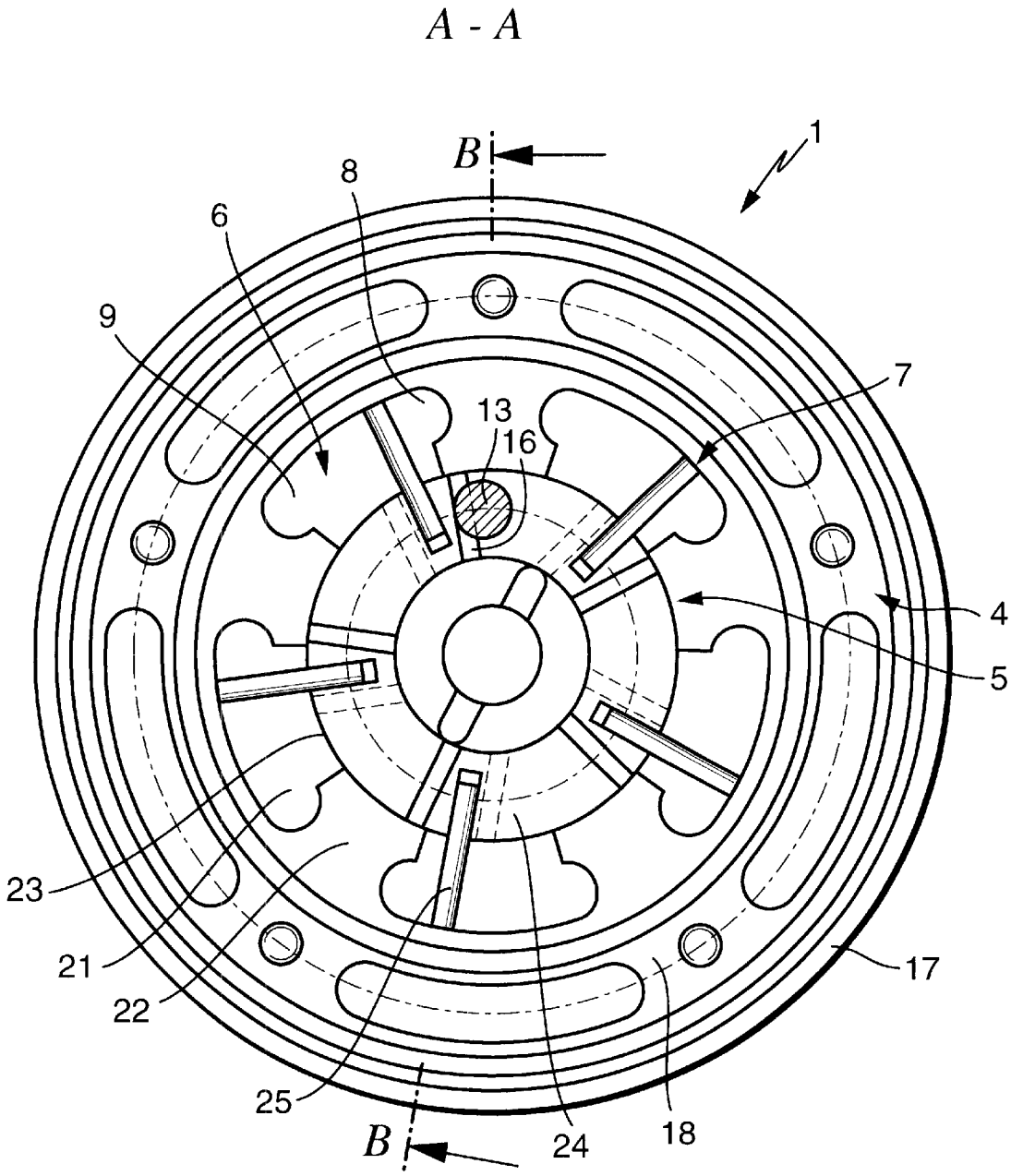
FIG. 2 is a top view of a camshaft adjusting device corresponding to section A—A of FIG. 1.

FIGS. 1 and 2 show a device 1 for varying the valve timing of an internal combustion engine with reference to which the method of the invention will be described by way of example. The device 1 belongs to the so-called rotary piston devices and is designated as a vane-type adjuster. This device 1, as also the so-called axial piston devices, is generally configured as a hydraulic adjusting drive and is arranged on the drive-side end of a camshaft 3 mounted in the cylinder head 2 of the internal combustion engine. The device 1 comprises, in a known manner, an element 4 fixed to the crankshaft of the internal combustion engine in driving relationship with the crankshaft, and an element 5 rotationally fixed to the camshaft 3, said elements 4, 5 being in power-transmitting relationship through at least one hydraulic working chamber 6 formed within the device 1. As can be seen in FIGS. 1 and 2, the element 4 fixed to the crankshaft is formed by a drive pinion 17 configured as an outer rotor which comprises a hollow space 21 defined by a hollow cylindrical circumferential wall 18 and two side walls 19, 20. In the present example, five hydraulic working chambers 6 are formed in the hollow space 21 by five limiting walls 22 extending from the circumferential wall 18 towards the central longitudinal axis of the device 1. The element 5 fixed to the camshaft is formed by a rotor 23 that is inserted into the hollow space 21 of the drive pinion 17 and comprises five vanes 25 arranged on its hub 24, each vane 25 extending radially into one of the hydraulic working chambers 6. The vanes of this rotor 23, that is configured as an adjusting element 7 within the device 1, divide each hydraulic working chamber 6 of the device 1 into an A pressure chamber and a B pressure chamber, which chambers, upon a selective or a simultaneous pressurization by a hydraulic pressure medium effect a pivoting or a fixing of the rotor 23 relative to the drive pinion 17 and, thus, of the camshaft 3 relative to the crankshaft of the internal combustion engine. The pressurization of the A and/or B pressure chamber of each hydraulic working chamber 6 is regulated by the electromagnetically actuated valve piston of a hydraulic valve 10, schematically represented in FIG. 1, whose solenoid 11 is actuated as a function of different operation parameters of the internal combustion engine by a microprocessor 12, also represented only schematically in FIG. 1. The hydraulic valve 10, configured as a 4/3 directional control valve, is connected to a pressure medium pump 26 and a pressure medium reservoir 27 and enables, in the position of its valve piston shown in FIG. 1 which corresponds to a non-energized or low energized solenoid 11, a pressurization of the B pressure chamber 9, in the position of its valve piston: corresponding to a high or maximum energized solenoid. 11, a pressurization of the A pressure chamber 8, and in a central position of its valve piston, a holding of the pressure medium pressure in both pressure chambers 8, 9 of each hydraulic working chamber 6 of the device 1.

A further feature of the device 1 shown in FIGS. 1 and 2 is that, after the internal combustion engine has been switched off, accompanied by a volume minimization of the A pressure chambers 8 of the hydraulic working chambers 6, the element 5 fixed to the camshaft and configured as a rotor 23 can be coupled mechanically to the element 4 fixed to the crankshaft and configured as a drive pinion 17 in a preferred basic position for starting the internal combustion engine. Depending on whether the device 1 is mounted on an in let or an outlet camshaft, this basic position corresponds to a "retard" or an "advance" position of the camshaft 3 relative to the crankshaft which is reached when the vanes 25 of the rotor 23 come into an end position on one or the other of the limiting walls 22 of each hydraulic working chamber 6. FIG. 2 shows a device 1 connected to an outlet camshaft with the rotor 23 rotated almost into the basic i.e., "advance" position. As best seen in FIG. 1, the mechanical coupling is effected by a pin-like locking element 13 arranged for displacement in an axial bore, not referenced, in the hub 24 of the rotor 23. This locking element 13 can be displaced by a spring element 14 into a coupling position within a complementary reception 15 in the side wall 19 of the drive pinion 17. FIG. 2 further shows that the complementary reception 15 of the locking element 13 is arranged within the pressure medium supply 16 to a volume-minimized A pressure chamber 8 of a hydraulic working chamber 6 of the device 1, so that, when the internal combustion engine is started, the pressurization of the A pressure chambers of the hydraulic working chambers 6 results in a simultaneous pressurization of the reception 15 of the locking element 13 which is then displaced hydraulically, against the force of its spring element 14, into its uncoupling position in the axial bore in the hub 24 of the rotor 23.

To avoid a bracing moment acting on the locking element 13 due to a sudden pressurization of the volume-minimized A pressure chambers 8 on starting of the internal combustion engine, which bracing moment together with a mean moment of drag of the camshaft 3 also acting in the same direction, causes a jamming of the locking element 13 in its coupling position, the solenoid 11 of the hydraulic valve 10 is operated according to a first regulation strategy, provided by the invention and graphically represented in diagrams in FIGS. 3 and 4, to assure a jam-free movement of the locking element 13 into its uncoupling position. These diagrams show that on starting of the internal combustion engine, the solenoid 11 of hydraulic valve 10 is at first energized in a number of high frequency cycles of low and high energization 1, so that the valve piston of the hydraulic valve 10 oscillates in a range about its central position. This enables a rapid alternating pressurization of the A and the B pressure chambers 8, 9 of the hydraulic working chambers 6 of the device 1 with a pressure $P_A$ and $P_B$, represented in FIG. 4 as a broken and a solid line, respectively, with which the rotor 23 is held hydraulically in its basic position. Each high frequency cycle lasts for 4 ms to 10 ms and the time period t for all the cycles is limited to a range of 10 ms to 40 ms, or the total number of cycles is limited to 2 to 8 repetitions. During each cycle, the energization of the solenoid 11 is effected, once, with an electric current I having an intensity of between 5% above that required for the central position of the valve piston of the hydraulic valve 10 and 95% of the maximum intensity, and, once, with an electric current I having an intensity of between 5% of the maximum intensity and 5% below that required for the central position of the valve piston of the hydraulic valve 10. After the lapse of the time limit of 40 ms or also, as shown in the example represented in FIGS. 3 and 4, at the end of 5 cycles, this routine is broken off. This is followed by a renewed energization of the solenoid 11 for a further period of 4 ms to 10 ms with a current I having an intensity of between 5% above that required for the central position of the valve piston of the hydraulic valve 10 and 95% of the maximum intensity and a simultaneous check by the microprocessor 12 whether the rotor 23 has been angularly displaced relative to the drive pinion 17 out of its basic position and the locking element 13 has therefore taken its uncoupling position. If the microprocessor 12 determines that the rotor 23 is still in its basic position, the cycles are repeated with the same current intensity in the same number or time period till the microprocessor 12 registers that the rotor 23 has been angularly displaced relative to the drive pinion 17 out of its basic position and that the locking element 13 has therefore taken its uncoupling position. When such an angular displacement of the rotor 23 out of its basic position has been determined by the microprocessor 12, which can be the case after a number of routines have been performed, or as represented in FIGS. 3 and 4, already after performance of the first routine, the routine is likewise broken off and the solenoid 11 of the hydraulic valve 10 is immediately subjected to a current I that is defined by the microprocessor 12 and corresponds to an adjusted angular position of the rotor 23 relative to the drive pinion 17. This current has an intensity situated in a range above that required for the central position of the valve piston of the hydraulic valve 10 up to 100% of the maximum intensity.

A further possibility to avoid a bracing moment acting on the locking element 13 and, thus, a jamming the locking element 13 in its coupling position, is shown in the diagrams of FIGS. 5 and 6. According to these diagrams, the solenoid 11 of the hydraulic valve 10 is operated following a second regulation strategy of the invention in that the solenoid 11 is at first energized in a time period t of 40 ms to 80 ms with a current I between 90% and 100% of the maximum intensity, so that to begin with, again, only the volume-minimized A pressure chambers 8 of the hydraulic working chambers 6 of the device 1 and, thus also, the reception 15 of the locking element 13 are pressurized with a high pressure medium pressure $P_A$ corresponding to the broken-line pressure curve in FIG. 6. After the lapse of the time period of 40 ms to 80 ms, the microprocessor 12 checks whether the rotor 23 has been angularly displaced relative to the drive pinion 17 out of its basic position and the locking element 13 has therefore taken its uncoupling position. If the microprocessor 12 determines that the rotor 23 is still in its basic position, the solenoid 11 is energized for 10 ms to 40 ms with a current I between 0% and 10% of the maximum intensity to achieve a brief pressurization of the B pressure chambers 9 of the hydraulic working chambers 6 with a pressure medium pressure $P_B$ corresponding to the solid-line pressure curve in FIG. 6. This is followed by a repetition of the releasing attempt by a renewed energization of the solenoid 11 with a current I between 90% and 100% of the maximum intensity for 40 ms to 80 ms and a subsequent check by the microprocessor 12 to determine whether the rotor 23 has left its basic position. This repetition is carried out till the microprocessor 12 registers that the rotor 23 has been angularly displaced relative to the drive pinion 17 out of its basic position and the locking element 13 has therefore taken its uncoupling position. The determination of such an angular displacement of the rotor 23 out of its basic position, which can be the case already after the performance of one routine, or, as shown in FIGS. 5 and 6, only after the performance of 4 or more routines, is evaluated by the microprocessor 12 as a successful releasing attempt, so that, immediately thereafter, the microprocessor 12 energizes the solenoid 11 with a current I resulting from the operation parameters of the internal combustion engine. This current I has an intensity situated in a range above that required for the central position of the valve piston of the hydraulic valve 10 up to 100% of the maximum intensity and corresponds to an adjusted angular position of the rotor 23 relative to the drive pinion 17.

Reference numerals

1 Device
2 Cylinder head
3 Camshaft
4 Element fixed to crankshaft
5 Element fixed to camshaft
6 Hydraulic working chamber
7 Adjusting element
8 A pressure chamber
9 B pressure chamber
10 Hydraulic valve
11 Solenoid
12 Microprocessor
13 Locking element
14 Spring element
15 Reception
16 Pressure medium supply
17 Drive pinion
18 Circumferential wall
19 Side wall
20 Side wall
21 Hollow space
22 Limiting wall
23 Rotor
24 Hub
25 Vane
26 Pressure medium pump
27 Pressure medium reservoir t Time period P Pressure medium pressure $P_A$ Pressure medium pressure in A pressure chamber $P_B$ Pressure medium pressure in B pressure chamber

What is claimed is:

1. A method of actuating a device for varying the valve timing of an internal combustion engine, a camshaft adjusting device having a hydraulically releasable start locking, said device generally comprising following features:

the device (1) is arranged on the drive-side end of a camshaft (3) mounted in the cylinder head of the internal combustion engine and generally configured as a hydraulic adjusting drive, said device (1) comprising an element (4) fixed in driving relationship to a crankshaft of the internal combustion engine and an element (5) rotationally fixed to the camshaft (3), the element (4) fixed to the crankshaft is in power-transmitting relationship with the element (5) fixed to the camshaft through at least one hydraulic working chamber (6) formed within the device (1), each hydraulic working chamber (6) of the device (1) is divided by an adjusting element (7) within the device (1) into a pressure chamber (8) and a pressure chamber (9), a pivoting or fixing of the element (5) fixed to the camshaft relative to the element (4) fixed to the crankshaft is effected by a selective or a simultaneous pressurizing of the pressure chambers (8, 9) of each hydraulic working chamber (6), the pressurizing of pressure chambers (8, 9) of each hydraulic working chamber (6) is regulated by an electromagnetically actuated valve piston of a hydraulic valve (10) whose solenoid (11) is actuated by a micro processor (12) as a function of different operation parameters or the internal combustion engine, the valve piston of the hydraulic valve (10) permits, in a non-energized or low energized state of the solenoid (11), a pressurization of the pressure chamber (9), in a high or maximum energized state of the solenoid (11), a pressurization of the pressure chamber (8), and in a central position, a holding of the pressure medium pressure (P) in both pressure chambers (8, 9) of each hydraulic working chamber (6) of the device (1), when the internal combustion engine has been switched off and the volume of the pressure chamber (8) of each hydraulic working chamber (6) has been minimized, the element (5) fixed to the camshaft can be mechanically coupled to the element (4) fixed to the crankshaft in a preferred basic position for starting the internal combustion engine, the mechanical coupling is achieved by a locking element (13) arranged on the element (5) fixed to the camshaft or on the element (4) fixed to the crankshaft, which locking element (13) can be displaced by a spring element (14) into a coupling position within a complementary reception (15) in the element (4) fixed to the crankshaft or in the element (5) fixed to the camshaft, the complementary reception (15) of the locking element (13) is hydraulically connected to the pressure medium supply (16) to a volume-minimized pressure chamber (8) of at least one hydraulic working chamber (6) of the device (1), upon pressurization of the volume-minimized pressure chamber (8) of each hydraulic working chamber (6) during starting of the internal combustion engine, the reception (15) of the locking element (13) is likewise pressurized and the locking element (13) is displaced hydraulically, against the force of its spring element (14), into an uncoupling position, characterized in that, to achieve a jam-free displacement of the locking element (13) into its uncoupling position, the solenoid (11) of the hydraulic valve (10) is energized during starting of the internal combustion engine using following regulation strategy:

(a) energization for a defined period of time (t), through a number of high frequency cycles of high and low energization (I), or through a defined number of such cycles, so that the valve piston of the hydraulic valve (10) oscillates in a range about its central position and enables a rapid alternating pressurization of the pressure chambers (8, 9) of each hydraulic working chamber (6) of the device (1) with a pressure (P) with which the element (5) fixed to the camshaft is held in its basic position, (b) at the end of the defined period of time (t) or the last cycle, the routine is broken off and followed by a renewed energization or a holding of the high energization (I) for a further defined period of time (t) in which the microprocessor (12) simultaneously checks whether the element (5) fixed to the camshaft has been angularly displaced relative to the element (4) fixed to the crankshaft out of its basic position and the locking element (13) has therefore taken its uncoupling position, (c) if the microprocessor (12) determines that the element (5) fixed to the camshaft is still in its basic position, steps (a) and (b) are repeated till the microprocessor (12) registers that the element (5) fixed to the camshaft has been angularly displaced relative to the element (4) fixed to the crankshaft out of its basic position and that the locking element (13) has therefore taken its uncoupling position, (d) when the microprocessor (12) determines an angular displacement of the element (5) fixed to the camshaft out of its basic position, energization with a current (I) defined by the microprocessor (12) which is of a higher intensity than that required for the central position of the valve piston of the hydraulic valve (10) and corresponds to an adjusted angular position of the element (5) fixed to the camshaft relative to the element (4) fixed to the crankshaft.

2. Method according to claim 1, characterized in that the high and the low energization (I) of the solenoid (11) of the hydraulic valve (10) is preferably controlled by a pulse width modulated voltage control of the microprocessor (12), so that the energization of the solenoid (11) within one cycle is effected, once, with an electric current (I) having an intensity between 5% above that required for the central position of the valve piston of the hydraulic valve (10) and 95% of the maximum intensity, and, once, with an electric current (I) having an intensity of between 5% of the maximum intensity and an intensity that is 5% lower than that required for the central-position of the valve piston of the hydraulic valve (10).

3. Method according to claim 1, characterized in that, according to a criterion for breaking off the routine defined in terms of time, the duration (t) of one cycle is preferably between 4 ms and 10 ms and the period of time for all the cycles required to displace the locking element (13) into its uncoupling position till the breaking off of the routine is preferably limited to a time (t) in the range of 10 ms to 40 ms.

4. Method according to claim 1, characterized in that, according to a numerically defined criterion for breaking off the routine, the number of cycles required to displace the locking element (13) into its uncoupling position till the breaking off of the routine is limited to 2 to 8 repetitions.

5. A method of actuating a device for varying the valve timing of an internal combustion engine, particularly a camshaft adjusting device having a hydraulically releasable start locking, said device comprising the features of the preamble of claim 1 characterized in that, to achieve a jam-free displacement of the locking element (13) into its uncoupling position, the solenoid (11) of the hydraulic valve (10) is energized during starting of the internal combustion engine using following strategy:

a) energization with a high current (I) in a defined period of time (t), so that, at first, only the volume-minimized pressure chamber (8) of each hydraulic pressure chamber (6) of the device (1) and, thus also, the reception (15) of the locking element (13) is pressurized with a high pressure medium pressure ($P_A$), b) at the end of the defined period of time (t), the microprocessor (12) checks whether the element (5) fixed to the camshaft has been angularly displaced relative to the element (4) fixed to the crankshaft out of its basic position and that the locking element (13) has therefore taken its uncoupling position, c) it the microprocessor (12) determines that the element (5) fixed to the camshaft is still in its basic position, the solenoid (11) is energized with a low current (I) for a further period of time (t) for a brief pressurization of the pressure chamber (9) of each hydraulic working chamber (6) with a pressure medium pressure ($P_B$) followed by a repetition of steps a) and b) till the microprocessor (12) registers that the element (5) fixed to the camshaft has been angularly displaced relative to the element (4) fixed to the crankshaft out of its basic position and that the locking element (13) has therefore taken its uncoupling position, d) after determination of an angular displacement of the element (5) fixed to the camshaft out of its basic position, energization with a current (1) defined by the microprocessor (12) which is of a higher intensity than that required for the central position of the valve piston of the hydraulic valve (10) and corresponds to an adjusted angular position of the element (5) fixed to the camshaft relative to the element (4) fixed to the crankshaft.

6. Method according to claim 5, characterized in that the energization (I) of the solenoid (11) of the hydraulic valve (10) is preferably controlled by a pulse width modulated voltage control of the microprocessor (12), so that the solenoid (11) is energized with a high current (I) of preferably between 90% and 100% and with a low current (I) of preferably between 0% and 10% of the maximum possible electric current (I).

7. Method according to claim 5, characterized in that the time period (t) of high energization (I) is preferably between 40 ms an 80 ms while the time period (t) of low energization (I) is limited preferably to a range from 10 ms to 40 ms.

* * * * *